United States Patent [19]

Noach

[11] Patent Number: 4,793,109

[45] Date of Patent: Dec. 27, 1988

[54] METHOD AND APPARATUS FOR FACING WOODEN DOOR FRAMES

[76] Inventor: Eizen Noach, 34 Ben-Gurion St., Rishon-le-Zion, Israel

[21] Appl. No.: 856,536

[22] Filed: Apr. 25, 1986

Related U.S. Application Data

[63] Continuation-in-part of Ser. No. 637,008, Aug. 2, 1984, abandoned.

[30] Foreign Application Priority Data

Aug. 16, 1983 [IL] Israel ..... 69506

[51] Int. Cl.[4] ..... E06B 1/20

[52] U.S. Cl. ..... 52/211; 403/408.1; 403/505

[58] Field of Search ..... 52/210, 211; 49/212, 49/505; 403/13, 405, 407, 408; 411/387, 171, 546, 533, 368, 369, 370, 427

[56] References Cited

U.S. PATENT DOCUMENTS

| | | | |
|---|---|---|---|
| 1,715,579 | 6/1929 | Thye . | |
| 2,721,634 | 10/1955 | Barraco | 52/211 |
| 3,084,958 | 4/1963 | Appleton | 411/368 |
| 3,224,152 | 12/1965 | Evans . | |
| 3,906,671 | 9/1975 | Maldonado | 49/505 |
| 4,126,975 | 11/1978 | Williams | 52/211 |
| 4,197,030 | 4/1980 | Debaigt | 403/408 |
| 4,437,784 | 3/1984 | Peterson | 403/408 |

FOREIGN PATENT DOCUMENTS

| | | | |
|---|---|---|---|
| 29525 | 11/1967 | Australia . | |
| 1061052 | 12/1954 | France | 403/405 |

*Primary Examiner*—David A. Scherdel
*Assistant Examiner*—Caroline D. Dennison

[57] ABSTRACT

Method and apparatus for facing wooden door jambs eliminating need for spacers. The apparatus comprises at least one profiled steel jamb facing member having an aperture of a diameter equal to the root diameter of the screw to be screwed therein, thereby preventing the screw from rotating further once the screw head engages the rim of the aperture. The profiled member is first aligned and levelled relative to the door jamb, held in place, and the screw inserted and tightened until it cannot be further rotated. Thus, the plumb and level position of the member is determined in advance and fixed merely by insertion of the screw as far as it can turn.

8 Claims, 3 Drawing Sheets

METHOD AND APPARATUS FOR FACING WOODEN DOOR FRAMES

This Application is a continuation-in-part of co-pending Application Ser. No. 637,008, filed Aug. 2, 1984, abandoned.

The present invention concerns a method and apparatus for facing wooden jambs and lintels of door openings with profiled steel members for the purpose of mounting steel doors to said openings. For the sake of the present invention, jambs and lintels will collectively be called jambs.

The simplest and most common method for facing such jambs is by mounting with metal profiles adjacent the jamb edge. It can be appreciated that aligning the profile with the jamb parallel, plumb and level along three dimensions is not an easy task, and numerous solutions for this have been proposed. This task of facing the jambs is further complicated when the facing is constituted of two profile members which can move in different directions and therefore alignment becomes more difficult.

It is one object of the present invention to provide a method and apparatus for facing wooden door jambs with profiled steel members.

It is another objective of the present invention to provide a method and apparatus for facing wooden door jambs parallel, plumb, and level without using spacers.

It is yet another objective of the present invention to provide a method and apparatus for facing wooden door jambs, parallel, plumb, and level, by merely screwing the profile into the jamb, yet maintaining the desired spacing.

These and other objectives and advantages of the invention will become apparent from the following detailed description and drawings.

DESCRIPTION OF THE PRIOR ART

Figure 1:
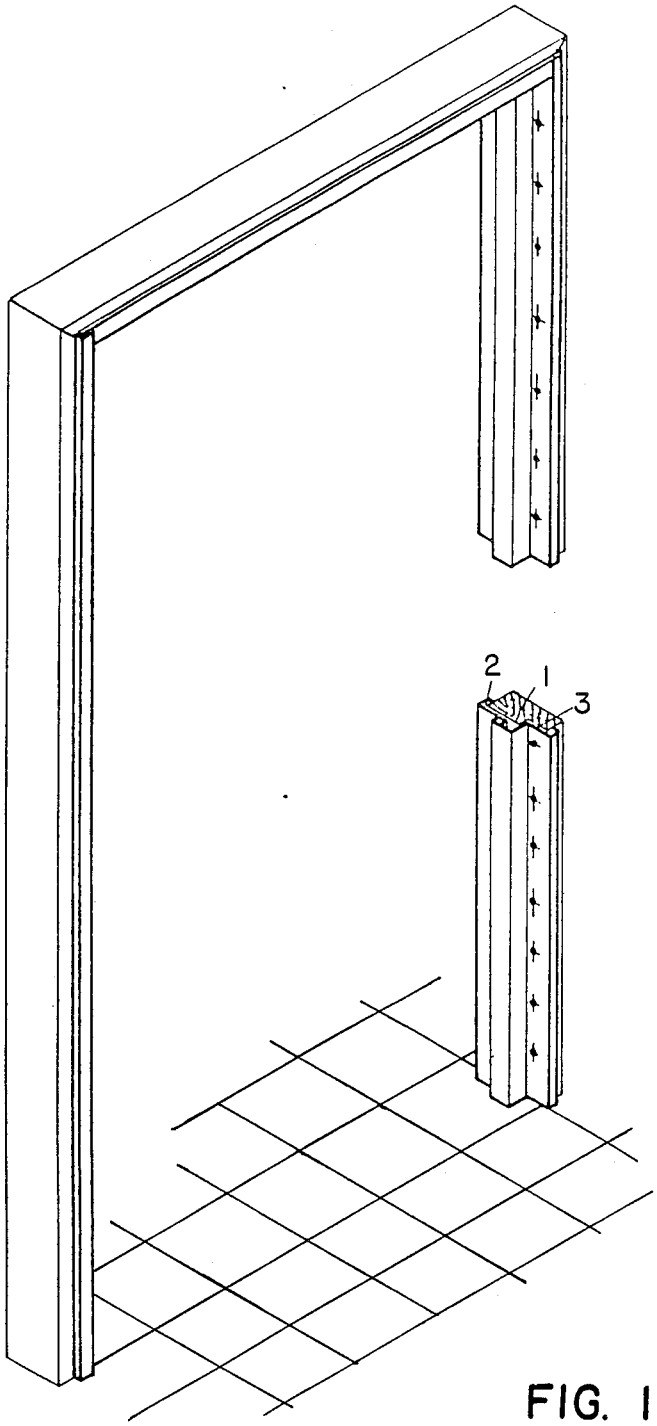
FIG. 1 is a perspective view of a door jamb.
Figure 2:
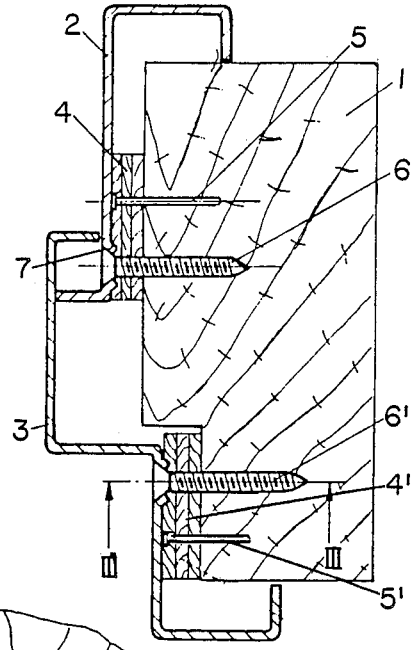
FIG. 2 PRIOR ART
FIG. 2 is a cross-section of a prior art profiled facing mounted to the jamb.
Figure 3:
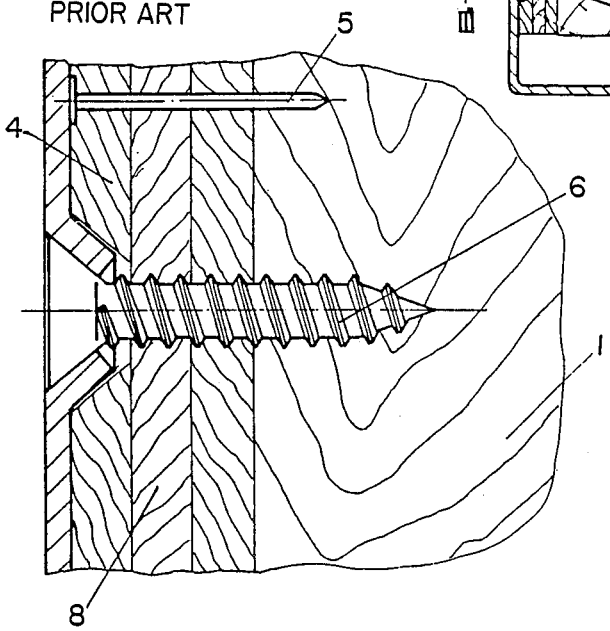
FIG. 3 PRIOR ART
FIG. 3 is a section of FIG. 2 on an enlarged scale, taken along line III—III.

The most common method of facing wooden jambs with metal profiles is as follows:

A profiled member is first fastened near one of its longitudinal ends, adjacent to the jamb at the point where the jamb protrudes the most. Then the remaining length of the profiled member is aligned plumb and level with respect to the jamb, usually with a water level. Turning now to FIGS. 2 and 3, a spacer 4 of proper thickness is then inserted between profiled member 2 and jamb 1, and a mark is made on the spacer through hole 7. The profiled member is then moved slightly and the spacer 4 is fixed in place, usually with a nail 5. The profiled member 2 is then returned to its plumb and level position by placing the hole 7 over the mark, and it is fixed therein with screw 6 inserted through hole 7 and screwed through spacer 4 into the wooden jamb 1. Thereafter, profile 3 which overlaps profile 2 is attached to jamb 1 in a similar manner; i.e., by providing spacers 4' nailed to jamb 1 by nail 5' and screw 6'. The holes in the profiled members are generally equal to or slightly larger than the outer diameter of the screw in order to facilitate inserting the screw into the profile member.

The number and thickness of spacers varies along the jamb, since the wooden beams are not of exact plumb and level position.

It can be appreciated that a skilled workman has to determine the number of spacers required between the profiles and jamb to ascertain proper position of said profiles on said jamb. This is both time consuming, increases the labor costs and adds spacer costs.

Another method for solving this problem is disclosed in U.S. Pat. No. 3,906,671, wherein a shim arrangement is provided for the purpose of proper spacing.

DESCRIPTION OF THE PREFERRED EMBODIMENT

In the preferred embodiment of this invention, the general method described above is followed in the initial stages. However, instead of using spacers, which must be of varying sizes adaptable for varying degrees of warping of the jamb, the desired spacing is achieved by merely using a suitable screw and aperture combination.

Figure 4:
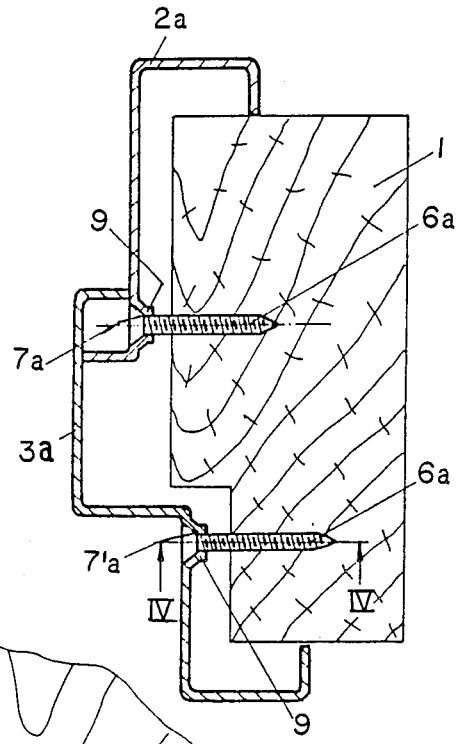
FIG. 4 is a cross-section of a profiled facing mounted to the jamb according to the invention.
Figure 5:
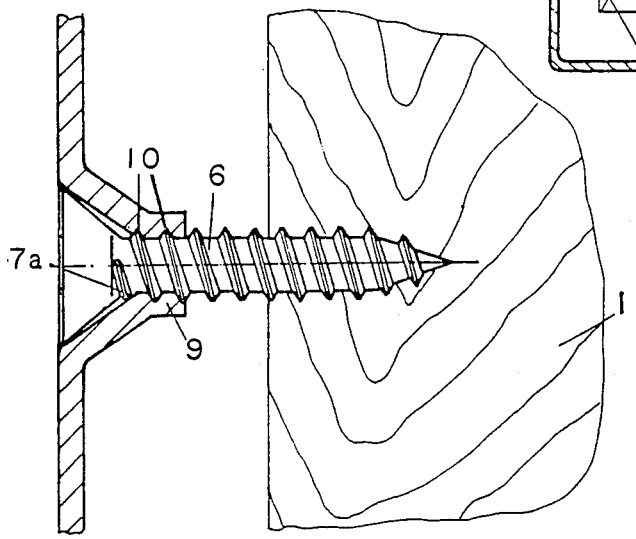
FIG. 5 is a section of FIG. 4 on an enlarged scale taken along line IV—IV.

With reference to FIGS. 4 and 5, the wooden jamb 1 is covered with steel profiled sections **2*a* and 3*a*, having countersunk holes 7*a* and 7'*a*. These holes are of a diameter equal to the root diameter of self-tapping screws 6*a* and 6'*a*, and are optionally provided with integral extension 9, which can be made by deep-drawing. This extension 9 provides increased guidance and hold for screws 6 and 6', because of the grooves 10 made by screws 6 and 6*a* when turned in holes 7*a* and 7'*a*. If desired, extension 9 may be eliminated and the desired holding effect of hole 7*a* is effected by the thickness of profiled members 2*a* and 3*a* only, through which the screw has to be threaded. It can be seen from FIGS. 4 and 5 that, as the self-tapping screw 6*a* is screwed first through hole 7*a* and its extension 9, and then into jamb 1, proper spacing between the profiled sections and the jamb are attained automatically without introducing spacers as long as the profiled member is held by hand in place distanced from the jamb at the position plumb and level thereto, as determined with a level. It will be noted that the hole 7*a*** acts like a nut, preventing further rotation of the screw once it is fully inserted, and thus preventing the profiled member from being advanced any further toward the jamb than was set by hand alignment plumb and level with respect to the jamb.

No spacers are needed nor are spring or clamping mechanisms required to maintain proper spacing of the facing profiled members plumb and level adjacent to the jamb. This is achieved merely by using a suitable screw and proper hole diameter. The present method is extremely simple, and enables experienced workmen to increase productivity by reducing installation time and dispensing with carrying a stock of spacers.

In an alternate embodiment of this invention, extension 9 can be replaced by a threaded nut welded or riveted on the inside of hole **7*a*. It is also possible to make profiled units 2*a* and 3*a*** as a single integral unit if desired.

I claim:

1. A method of facing wooden jambs with at least one elongated profiled steel member for use in mounting of doors wherein said profiled member is aligned and fastened near one end thereof adjacent said jamb, and then said profiled member is aligned and spaced by hand along its length, plumb and level, with a flat portion thereof facing and spaced from said jamb within the plane of said doorway and disposed in a plane generally parallel to said jamb, to provide the proper spacing between said profiled member and said jamb, comprising the further steps of aligning at least one screw with a corresponding aperture in said flat portion of said profiled member, said screw disposed on an axis normal to the plane of said flat portion.

threading said screw first into said corresponding aperture in said flat portion of said profiled member and, after said profiled member is confirmed to be plumb and level, second into said jamb, so that, from the time said screw begins engaging said jamb, said screw is in threaded engagement with both said profiled member and said jamb as it is turned, and turning said screw until it cannot rotate any further, said screw engaging only the boundary of said aperture and said jamb, said aperture having a diameter equal to the root diameter of said screw, whereby, as said screw is turned in said aperture, it is threaded therethrough, and its point will first engage with the surface of said jamb and then enter the body of said jamb, the screw, solely, maintaining the same spacing and a constant planar relationship from thence on between said member and said jamb until rotation of the screw is stopped by the bottoming of the screw head against the inner surface of said aperture, whereupon, said facing, plumb and level and spaced from said jamb, is fixed permanently in place generally parallel to and spaced from said jamb solely by the engagement of said screw head with the boundary of said aperture and the threaded engagement of said screw with the body of said jamb.

2. A method as claimed in claim 1, wherein said at least one screw is self-tapping.

3. A method as claimed in claim 9 wherein an integral, internal extension is provided for said aperture.

4. A method as claimed in claim 3, wherein said extension is made by deep-drawing.

5. A method as claimed in claim 3, wherein said extension is made by welding or riveting a nut or cylinder to said profiled steel member concentrically with said aperture.

6. In combination with a wooden door jamb defining a doorway, a facing for use in mounting a door in said doorway, said facing comprising at least one elongated profiled steel member having a flat portion thereof located within the plane of said doorway, and disposed in a plane running generally parallel to, spaced from and adjacent said jamb, said flat portion having at least one thread-receiving aperture opening toward the adjacent surface of said jamb, a screw threadedly received in said aperture and threadedly engaged in said jamb, said screw disposed on an axis normal to the plane of said flat portion, and being threadedly engaged with both said profiled member and said jamb as it is turned and engaging only the boundary of said aperture and said jamb, said aperture having a diameter equal to the root diameter of said screw, whereby as said screw is turned threadedly in said aperture its point will first engage with the surface of said jamb and then enter the body of said jamb from whence on the screw, solely, will maintain the same spacing and a constant planar relationship between said member and said jamb until rotation of said screw is stopped by the bottoming of the screw head against the inner surface of said aperture whereupon said facing, plumb and level and spaced from said jamb is fixed permanently in place generally parallel to and spaced from said jamb solely by the engagement of said screw head with the boundary of said aperture and the threaded engagement of said screw with the body of said jamb.

7. A facing according to claim 6, wherein said aperture also defines an integral extension.

8. A screw in accordance with claim 6, wherein said screw is self-tapping in both said aperture and said jamb.

* * * * *

UNITED STATES PATENT AND TRADEMARK OFFICE

CERTIFICATE OF CORRECTION

PATENT NO. : 4,793,109

DATED : December 27, 1988

INVENTOR(S) : Eizen Noach

It is certified that error appears in the above-identified patent and that said Letters Patent is hereby corrected as shown below:

On the cover page:

[56] References Cited

After Thye insert -- 52/212 --

After Evans insert -- 52/217 --

FOREIGN PATENT DOCUMENTS

Delete "29525 11/1967" and insert -- 429879 11/1972 --

Change "1061052" to -- 1081052 --

Col. 3, line 13, after "portion" change "." to -- , --
Col. 3, line 44, change "9" to -- 1 --

Signed and Sealed this

Sixteenth Day of May, 1989

*Attest:*

*Attesting Officer*

DONALD J. QUIGG

*Commissioner of Patents and Trademarks*